United States Patent [19]

Allen

[11] 4,412,803

[45] * Nov. 1, 1983

[54] ADJUSTABLE SUPPORT BRACKET FOR CONCRETE FINISHING EQUIPMENT

[75] Inventor: J. Dewayne Allen, Paragould, Ark.

[73] Assignee: Allen Engineering Corporation, Paragould, Ark.

[ * ] Notice: The portion of the term of this patent subsequent to Feb. 23, 1999, has been disclaimed.

[21] Appl. No.: 343,283

[22] Filed: Jan. 27, 1982

Related U.S. Application Data

[63] Continuation-in-part of Ser. No. 34,171, Apr. 26, 1979, Pat. No. 4,316,715.

[51] Int. Cl.[3] ..... E01C 19/38

[52] U.S. Cl. ..... 425/456; 404/119; 404/120

[58] Field of Search ..... 404/118, 119, 120; 425/456, 458; 249/1, 2, 208

[56] References Cited

U.S. PATENT DOCUMENTS

| | | | |
|---|---|---|---|
| 2,248,247 | 7/1941 | Nichols | 404/120 |
| 2,542,979 | 2/1951 | Baines | 404/114 |
| 2,866,394 | 12/1958 | Smith | 404/119 |
| 3,015,257 | 1/1962 | Apel | 404/120 |
| 3,125,935 | 3/1964 | McCandless | 404/118 |
| 3,164,072 | 1/1965 | Blankenship | 404/120 |
| 3,251,281 | 5/1966 | Iannetti | 404/120 |
| 3,415,173 | 12/1968 | Paul | 404/118 |
| 3,435,740 | 12/1969 | McCall | 404/120 |
| 3,512,461 | 5/1970 | Witchey | 404/120 |
| 3,523,494 | 8/1970 | Kraemer | 404/119 |
| 3,702,578 | 11/1972 | Darin | 404/118 |
| 3,957,384 | 5/1976 | Lamb | 404/118 |
| 4,030,873 | 6/1977 | Morrison | 404/119 |
| 4,115,976 | 9/1978 | Rohrer | 404/119 |
| 4,213,749 | 7/1980 | Morrison | 425/456 |

FOREIGN PATENT DOCUMENTS

| | | | |
|---|---|---|---|
| 2449127 | 4/1976 | Fed. Rep. of Germany | 404/96 |
| 1382163 | 1/1975 | United Kingdom | 404/118 |

OTHER PUBLICATIONS

"Adjustable Strikeboard Given Variable Curb Exposure", *Concrete Highway Magazine*, Jul.-Aug. 1921, vol. 5, No. 4, p. 94.

*Primary Examiner*—John A. Parrish

*Attorney, Agent, or Firm*—Cahill, Sutton & Thomas

[57] ABSTRACT

A laterally and vertically adjustable support bracket can be coupled to an end of concrete finishing equipment such as a vibratory concrete screed to permit the equipment to be operated on a concrete surface which includes obstructions extending vertically from the edge area. The adjustable support bracket includes a vertical bracket element which is coupled to the end of the concrete finishing equipment. A vertically extending member is spaced apart from the vertical bracket element and engages a load bearing surface located outboard of the concrete surface. A laterally extending member extends between the vertical bracket element and the vertically extending member and includes various adjustment devices for varying the lateral spacing and relative vertical alignment between the vertical bracket element and the vertically extending member. The structure of the adjustable bracket permits the end of the concrete finishing equipment to operate inboard of the vertically extending obstruction while being supported by the load bearing surface located outboard of the concrete surface.

17 Claims, 7 Drawing Figures

ADJUSTABLE SUPPORT BRACKET FOR CONCRETE FINISHING EQUIPMENT

This is a continuation-in-part of allowed application Ser. No. 34,171, filed Apr. 26, 1979 now U.S. Pat. No. 4,316,715 which is hereby incorporated by reference.

BACKGROUND OF THE INVENTION

1. Field of the Invention

This invention relates to concrete finishing equipment, and more particularly, to an adjustable support bracket which permits concrete finishing equipment to operate inboard of vertically extending obstructions positioned along the edge of a concrete surface.

2. Description of the Prior Art

Concrete contractors frequently encounter difficulties in attempting to finish the surface of plastic concrete which includes vertically extending obstructions such as anchor bolts, reinforcing steel or plumbing fixtures along the edge of the concrete surface. When encountering vertical obstructions of this type, concrete finishing equipment, such as a vibratory concrete screed, cannot travel along and be supported by the concrete forms located outboard of the vertical obstructions. Instead, lengths of two by four lumber or devices known in the field as pipe screeds must be embedded in the plastic concrete inboard of the vertical obstructions to support the concrete screed. Upon completion of the screeding operation, the embedded two by four supports or pipe screed elements must be removed from the plastic concrete and the depressions in the otherwise finished concrete surface must be hand finished. In many cases, scaffolding or a work bridge must be provided to permit proper access to the concrete surface for the worker accomplishing the hand finishing operation.

SUMMARY OF THE INVENTION

It is therefore a primary objective of the present invention to provide an adjustable support bracket for concrete finishing equipment which can be coupled to the end of the equipment to support the equipment inboard of obstructions extending vertically from the edge area of a plastic concrete surface without blemishing the finished concrete surface.

Another object of the present invention is to provide an adjustable support bracket for concrete finishing equipment which can engage a load bearing surface positioned outboard of the concrete surface at various lateral offsets from the edge of the concrete surface and at various vertical elevations.

Yet another object of the present invention is to provide an adjustable support bracket for concrete finishing equipment which includes a wide range of lateral and vertical adjustments.

Still another object of the present invention is to provide an adjustable support bracket for concrete finishing equipment which can be readily coupled to various different types of concrete finishing equipment.

Yet another object of the present invention is to provide an adjustable support bracket for concrete finishing equipment which can be quickly and accurately adjusted to provide the desired lateral and vertical offsets.

Briefly stated, and in accord with one embodiment of the invention, an adjustable support bracket is provided to support an end of equipment for finishing a concrete surface which includes an obstruction extending vertically from the edge area. The adjustable support bracket includes a support mechanism having a vertically extending member. The support mechanism engages a load bearing surface located outboard of the concrete surface and permits translation of the adjustable support bracket along the load bearing surface. The adjustable support bracket also includes an adjustable mechanism which incorporates a laterally extending member. The adjustment mechanism is coupled to the end of the concrete finishing equipment and to the support mechanism to maintain a desired lateral spacing between the end of the equipment and the support mechanism. The adjustment mechanism also permits the contact point between the support mechanism and the load bearing surface to be vertically adjusted while maintaining the end of the concrete finishing equipment in a fixed vertical position. In this manner, the end of the concrete finishing equipment operates inboard of the vertically extending obstruction while being supported by the load bearing surface located outboard of the concrete surface.

DESCRIPTION OF THE DRAWINGS

The invention is pointed out with particularity in the appended claims, however, other objects and advantages, together with the operation of the invention, may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
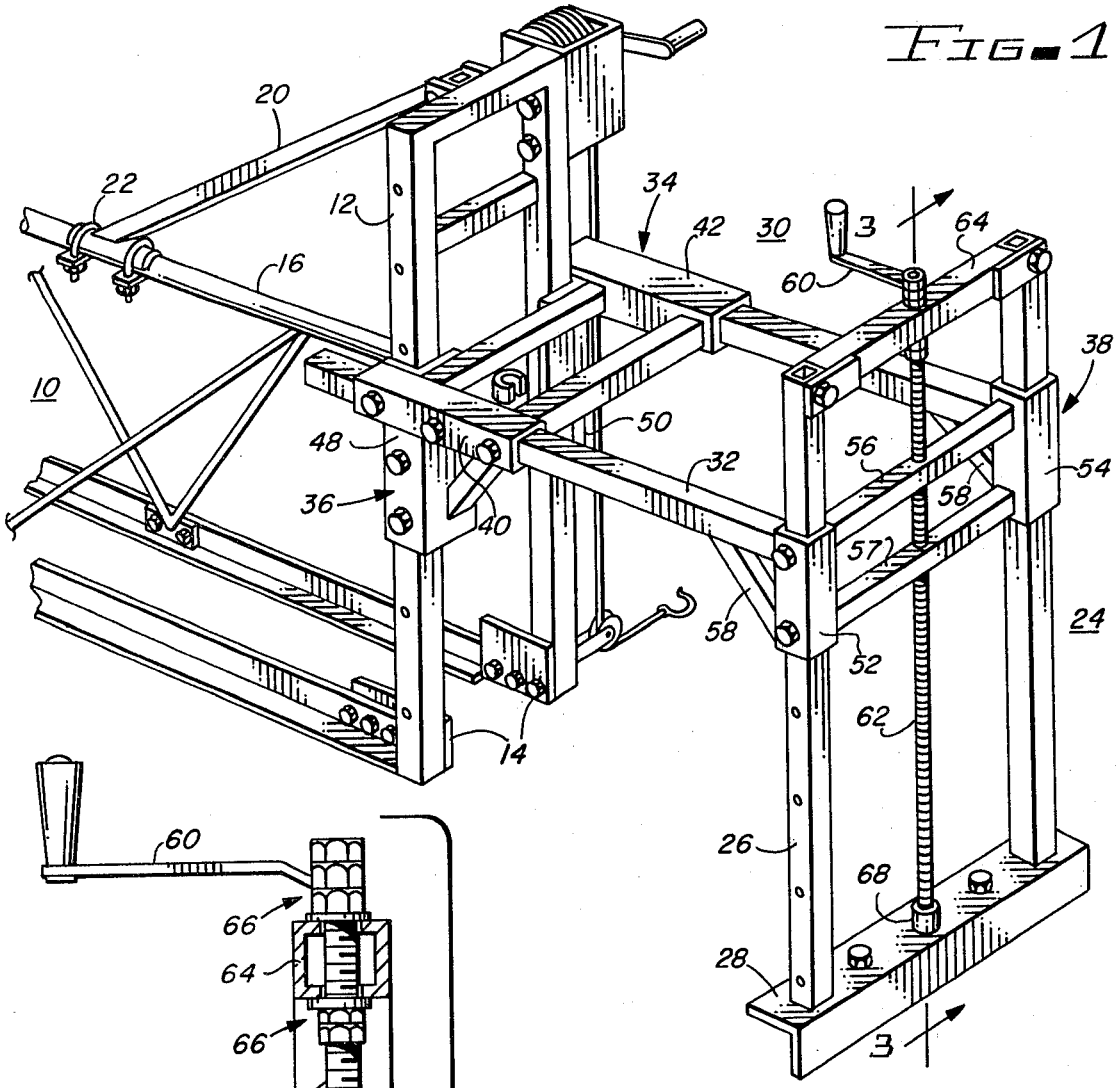
FIG. 1 is a perspective view of the preferred embodiment of the adjustable support bracket.
Figure 2:
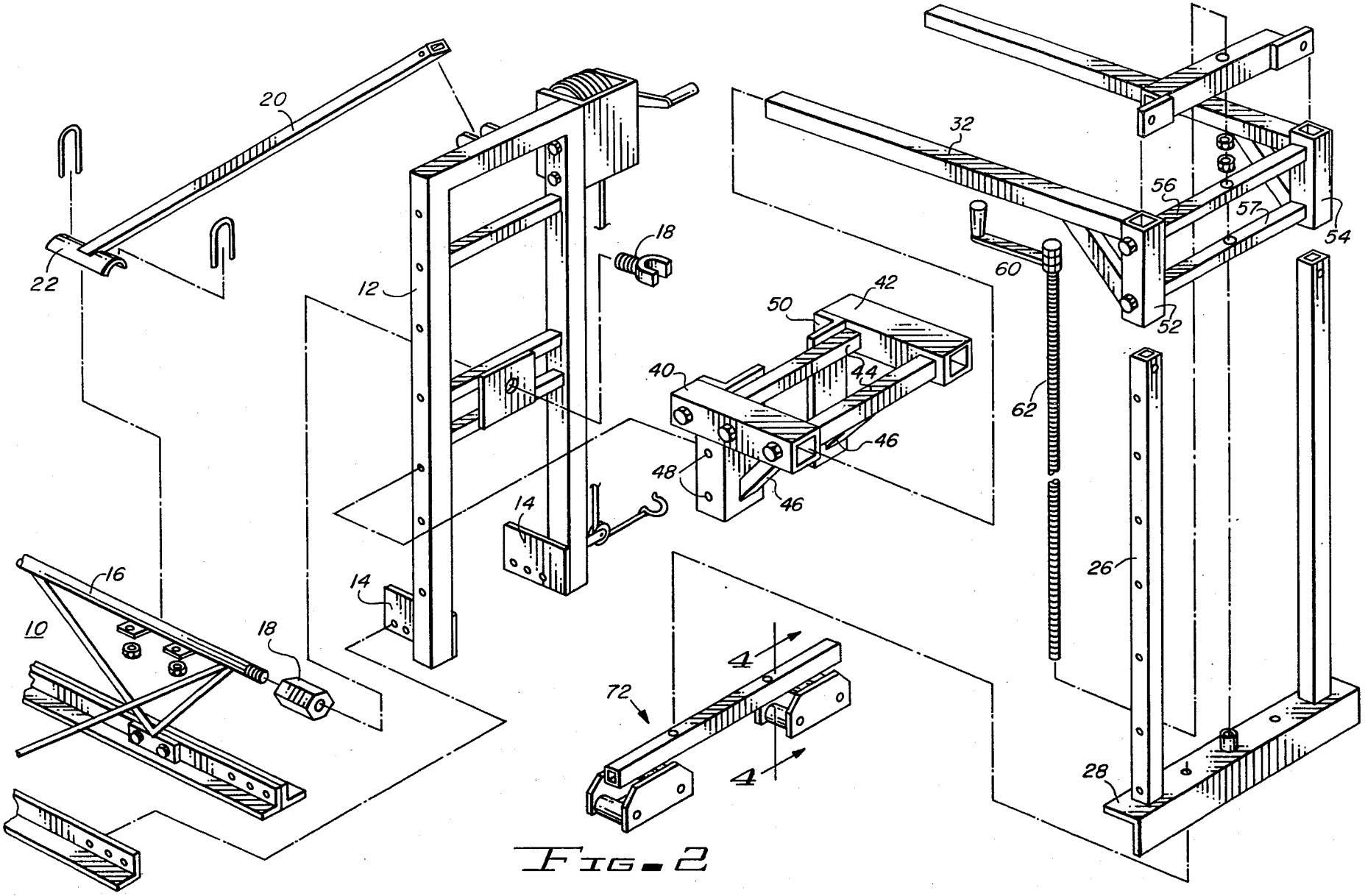
FIG. 2 is an exploded perspective view of the preferred embodiment of the adjustable support bracket, particularly illustrating the various separate component parts of the bracket.

Referring now to FIGS. 1 and 2, the adjustable support bracket of the present invention is typically coupled to one end of a piece of concrete finishing equipment such as a vibratory concrete screed 10 of the type depicted in FIG. 1. The standard screed end bracket (not shown) is typically removed to permit attachment of the adjustable support bracket.

The adjustable support bracket includes a vertical bracket element 12 having a pair of coupling plates designated by reference number 14 for securing the lower ends of vertical bracket element 12 to the front and rear blades of screed 10. The mid-section of vertical bracket element 12 is coupled to top pipe 16 of screed 10 by the crow's foot coupling hardware designated by reference number 18. An angled support bracket 20 is pivotally coupled to the upper horizontal element of vertical bracket element 12 and to top pipe 16 at an appropriate position by slideable clamp assembly 22.

Support means designated generally by reference number 24 includes a vertically extending member 26 and a horizontally oriented slide bracket 28 which is coupled to the lower end of member 26.

The adjustable support bracket of the present invention also includes adjustment means designated generally by reference number 30. Adjustment means 30 includes a laterally extending member 32 which is telescopically adjustable with respect to lateral adjustment means 34. Lateral adjustment means 34 is coupled to a first vertical adjustment means 36 which is telescopically adjustable with respect to vertical bracket element 12. A second vertical adjustment means 38 is coupled to remote end of laterally extending member 32 and permits telescopic adjustment of vertically extending member 26 with respect to laterally extending member 32.

As is evident from FIGS. 1 and 2, lateral adjustment means 34 includes paired rectangular tubes 40 and 42 which are dimensioned to be slideably adjustable with respect to the parallel oriented elements of laterally extending member 32. Each rectangular tube includes a grouping of three bolts which lock laterally extending member 32 in a predetermined position to determine the lateral offset between vertical bracket element 12 and vertical extending member 26. A pair of rectangular brace elements designated by reference number 44 maintain tubes 40 and 42 in the desired spaced apart relationship while angled brace elements designated by reference number 46 add further support to rectangular tubes 40 and 42.

First vertical adjustment means 36 is fabricated from a pair of vertically oriented, "L" shaped bracket elements 48 and 50. Bracket elements 48 and 50 are coupled to the sides of vertical bracket element 12 by securing means such as nuts and bolts which pass through vertically spaced apart, horizontally oriented apertures in the sides of vertical bracket element 12. These spaced apart apertures in vertical bracket element 12 provide a coarse vertical adjustment for the adjustable support bracket.

Second vertical adjustment means 38 consists of a pair of vertically oriented rectangular tubes designated by reference numbers 52 and 54 which are coupled together by horizontally oriented brace tubes 56 and 57 which are further secured to laterally extending member 32 by angled brace elements 58.

A jack screw adjustment means includes a rotary handle 60 which is coupled to a continuously threaded rod 62. Threaded rod 62 extends through an aperture in the upper horizontal member 64 of vertically extending member 26. Bolt and washer assemblies designated by reference number 66 are coupled to the threaded rod 62 directly above and below horizontal member 64 to maintain threaded rod 62 in a fixed position with respect to horizontal member 64 and to provide bearing surfaces. The lower end of threaded rod 62 is positioned within a bearing assembly 68 which is rigidly coupled to the upper horizontal surface of slide bracket 28. A pair of bolts designated by reference number 70 are rigidly coupled together and positioned within the interior of brace tube 56. Bolts 70 are dimensioned such that they are rotationally locked in position within brace tube 56. Threaded rod 62 extends through the aperture in the center of brace tube 56 and through the bolt assembly 70 and passes freely through the aperture in the center of lower brace tube 57.

Rotary displacements of handle 60 cause threaded rod 62 to rotate. Since second vertical adjustment means 38 includes brace tube 56 and is rigidly secured to laterally extending member 32, the bolt assembly 70 will remain in a fixed position with respect to laterally extending member 32 as threaded rod 62 is rotated. Rotary displacements of threaded rod 62 will therefore cause either upward or downward displacements of vertically extending member 26 with respect to screed 10. A pair of securing means in the form of bolts are coupled to the sides of rectangular tubes 52 and 54 to clamp vertically extending member 26 of support means 24 in the desired vertical position upon completion of the rotary adjustment of the jack screw adjustment means as described above. Typically one of each pair of the securing means will be aligned with one of the horizontally oriented apertures vertically extending member 26 and will provide an enhanced locking function.

Figure 4:
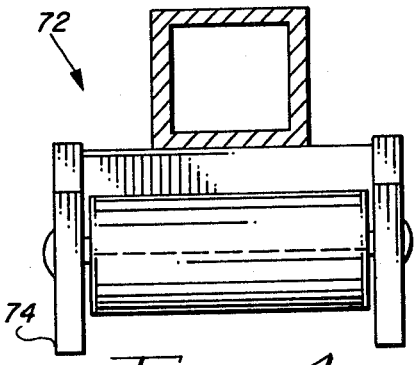
FIG. 4 is a cross sectional view of a roller assembly which can be coupled to the lower end of the vertically extending member of the adjustable support bracket.

FIGS. 2 and 4 illustrate that a roller assembly 72 can be coupled to the lower surface of slide bracket 28 to facilitate translations of the adjustable support bracket over various types of support forms. The vertically extending flanges 74 of roller assembly 72 maintain the roller assembly in a fixed lateral position with respect to round or pipe rectangular tube supports which are frequently coupled to the upper surface of wooden concrete forms. Roller assembly 72 is coupled to support bracket 28 by a pair of bolts and is therefore readily removed from or reattached to the adjustable support bracket.

Figure 3:
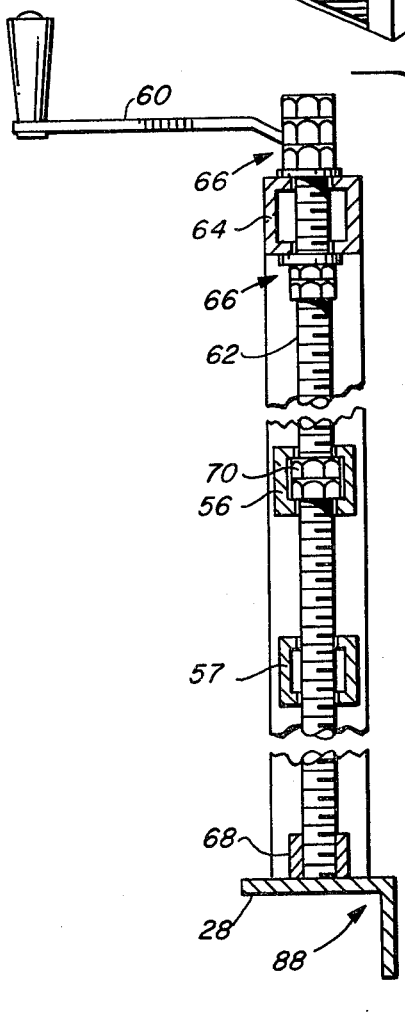
FIG. 3 is a partially cutaway, elevational view of the jack screw adjustment device of the adjustable support bracket illustrated in FIG. 1, taken along section line 3—3.

FIG. 3 best illustrates that the inner edge 88 of slide bracket 28 is beveled to facilitate sliding contact between the metal slide bracket and a wooden or other support form. It has been found helpful to apply a layer of grease to the inner horizontal and vertical surfaces of slide bracket 28 to reduce the friction between the slide bracket and the concrete forms.

Figure 5:
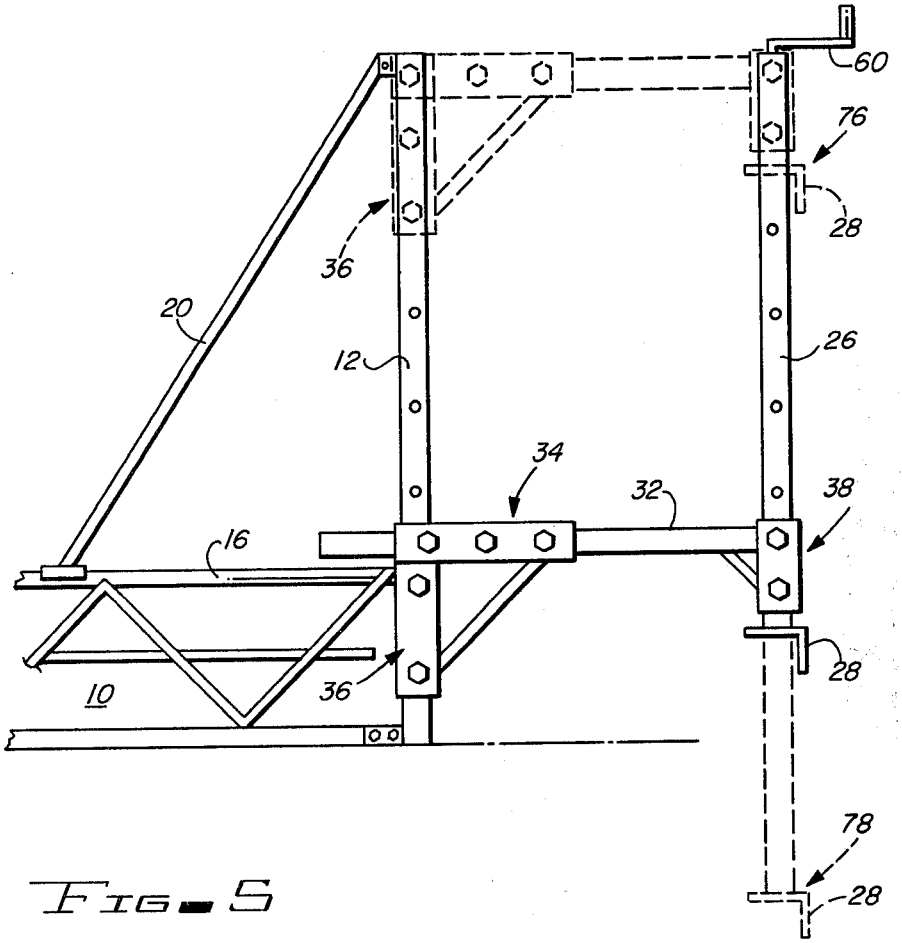
FIG. 5 is a side view of the adjustable support bracket, particularly illustrating the available range of vertical adjustments.

Referring now to FIG. 4, various different combinations of vertical adjustments of the adjustable support bracket are depicted, while the lateral position of the device is maintained fixed. First vertical adjustment means 36 is depicted in FIG. 5 in both its highest and lowest positions. Reference number 76 depicts support means 24 adjusted such that slide bracket 28 is at its highest possible vertical position, while reference number 78 depicts slide bracket 28 of support means 24 at its lowest position. In the preferred embodiment of the present invention, slide bracket 28 can be elevated up to thirty-three inches above the concrete surface and up to twenty-five inches below the concrete surface for a total available adjustment of fifty-one inches. The provision of two discrete vertical adjustment mechanisms provides this extremely wide latitude of vertical adjustments and furthermore provides for both coarse and fine vertical adjustments so that the adjustable support bracket of the present invention can be precisely and rapidly adjusted to properly interface with an outboard load bearing surface.

Figure 6:
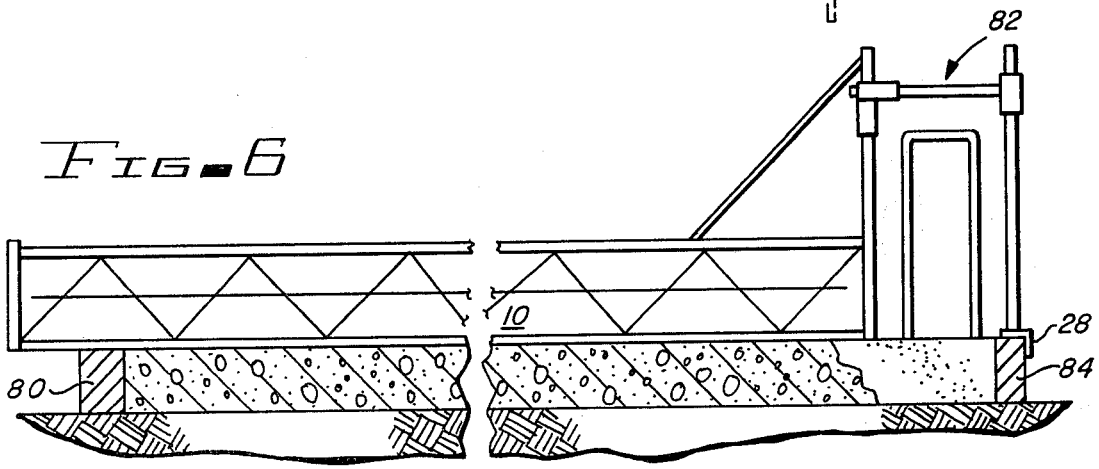
FIG. 6 illustrates the adjustable support bracket of the present invention coupled to one end of a concrete screed.

FIG. 6 illustrates the manner in which the adjustable bracket of the present invention is coupled to a concrete screed which spans the surface of a plastic concrete surface. A conventional concrete form designated by reference number 80 supports one end of the screed while the adjustable support bracket designated by reference number 82 supports the opposite end of the screed at a location inboard of the load bearing concrete form 84.

Figure 7:
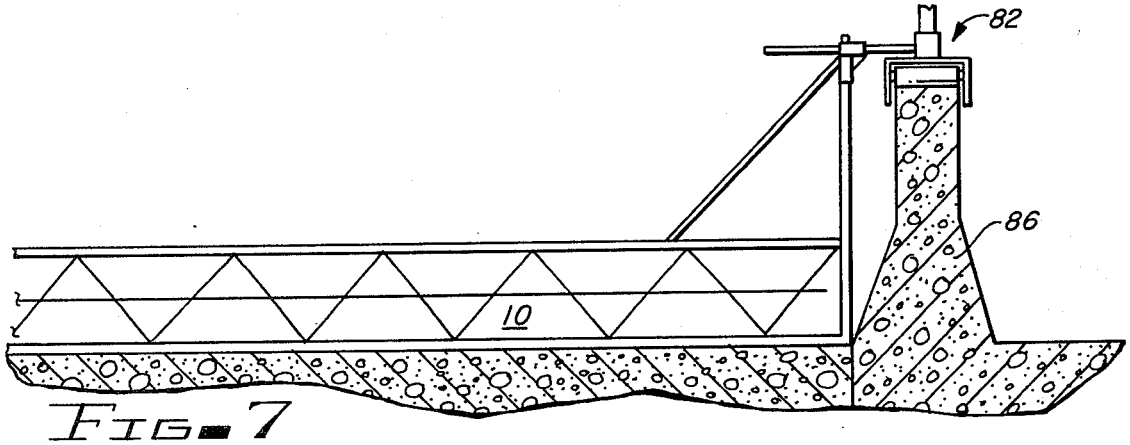
FIG. 7 illustrates the adjustable support bracket coupled to one end of a concrete screed and supported by a highway barrier wall.

FIG. 7 depicts another application of the adjustable support bracket 82. In this configuration, adjustable support bracket 82 is coupled to the end of a concrete screed and is supported by the flat upper surface of a concrete highway guard wall 86.

While the discussion of the adjustable support bracket has been limited to concrete screed applications, the adjustable support bracket can readily be coupled to many different types of concrete finishing equipment such as work bridges or concrete topping spreaders with the same highly advantageous results achieved in connection with the application of the invention to a concrete screed.

It will be apparent to those skilled in the art that the disclosed adjustable support bracket may be modified in numerous ways and may assume many embodiments other than the preferred form specifically set out and described above. For example, rather than providing a separate vertical bracket element 12, it is possible that first vertical adjustment means 36 could be directly coupled to an existing end bracket of the concrete finishing equipment to which the adjustable support bracket is secured. In addition, it may be appropriate in certain applications to provide only a single vertical adjustment device at either the left hand or right hand side of the adjustable support bracket. In other applications, only a single fixed lateral displacement for the adjustable support bracket may be required and lateral adjustment means 34 could be eliminated. Numerous other different configurations of the adjustable support bracket will be readily apparent to one of ordinary skill in the art and will accomplish the primary purpose of the present invention by enabling one end of a piece of concrete finishing equipment to be supported inboard of vertical obstructions while being supported by a load bearing surface located outboard of the concrete surface. Accordingly, it is intended by the appended claims to cover all such modifications of the invention which fall within the true spirit and scope of the invention.

I claim:

1. An adjustable support bracket for supporting an end of equipment for finishing a concrete surface including an obstruction extending vertically from the edge area, said adjustable support bracket comprising:

a. support means including a vertically extending member for engaging a load bearing surface positioned outboard of the concrete surface and for permitting translation of said bracket along the load bearing surface; and b. adjustment means including a laterally extending member coupled to the end of said equipment and to said support means for maintaining lateral spacing between said end of said equipment and said support means and for permitting the contact point between said support means and the load bearing surface to be vertically adjustable while maintaining the end of said equipment in a fixed vertical position, whereby the end of said concrete finishing equipment operates inboard of the vertically extending obstruction while being supported by the load bearing surface located outboard of the concrete surface.

2. The adjustable support bracket of claim 1 wherein said adjustment means includes lateral adjustment means for varying the lateral spacing between the end of said equipment and support means.

3. The adjustable support bracket of claim 1 wherein said adjustment means includes first vertical adjustment means coupled to said laterally extending member and to the end of said equipment for varying the vertical position at which said adjustment means is coupled to the end of said equipment.

4. The adjustable support bracket of claim 3 wherein said adjustment means includes a vertical bracket element coupled to the end of said equipment and wherein said first vertical adjustment means is coupled to said vertical bracket element.

5. The adjustable support bracket of claim 3 wherein said adjustment means includes second vertical adjustment means coupled to said laterally extending member and to said support means for varying the vertical position at which said adjustment means is coupled to said support means.

6. The adjustable support bracket of claim 1 wherein said support means includes a roller assembly for engaging the load bearing surface.

7. The adjustable support bracket of claim 1 further including jack screw adjustment means coupled to said support means and to said adjustment means for varying the relative vertical position of said support means with respect to said adjustment means.

8. The adjustable support bracket of claim 1 wherein said equipment includes a concrete screed.

9. The adjustable support bracket of claim 2 wherein said laterally extending member is telescopically adjustable with respect to said lateral adjustment means.

10. The adjustable support bracket of claim 1 wherein said adjustment means includes a vertical bracket element coupled to the end of said equipment.

11. The adjustable support bracket of claim 10 wherein said adjustment means includes first vertical adjustment means coupled to said laterally extending member and to said vertical bracket element for varying the vertical position at which said adjustment means is coupled to the end of said equipment.

12. The adjustable support bracket of claim 11 wherein said adjustment means includes second vertical adjustment means coupled to said laterally extending member and to said support means for varying the vertical position at which said adjustment means is coupled to said support means.

13. The adjustable support bracket of claim 12 wherein said first vertical adjustment means is telescopically adjustable with respect to said vertical bracket element.

14. The adjustable support bracket of claim 13 wherein said second vertical adjustment means is telescopically adjustable with respect to said vertically extending member.

15. The adjustable support bracket of claim 12 wherein said second vertical adjustment means includes jack screw adjustment means.

16. An adjustable support bracket for supporting an end of equipment for finishing a concrete surface including an obstruction extending vertically from the edge area, said adjustable support bracket comprising:

a. support means including a vertically extending member for engaging a load bearing surface positioned adjacent to the concrete surface and for permitting translation of said bracket along the load bearing surface;

b. a vertical bracket element coupled to the end of said equipment;

c. a laterally extending member having first and second ends;

d. first adjustment means coupled to said laterally extending member and to said vertical bracket element for securing said laterally extending member to said vertical bracket element at an adjustable vertical position and for varying the lateral spacing between said vertical bracket element and said support means;

e. second adjustment means coupled to said laterally extending member and to said vertically extending member for varying the vertical position at which said laterally extending member is coupled to said vertically extending member, whereby the end of said concrete finishing equipment operates inboard of the vertically extending obstruction while being supported by the load bearing surface located outboard of the concrete surface.

17. The adjustable bracket of claim 16 wherein said equipment includes a concrete screed.

* * * * *